US012774552B2

(12) United States Patent
Bellinger et al.

(10) Patent No.: US 12,774,552 B2
(45) Date of Patent: Oct. 27, 2026

(54) PARTICULATE REMOVAL SYSTEM FOR LAUNDRY DRYING APPLIANCES

(71) Applicant: WHIRLPOOL CORPORATION, Benton Harbor, MI (US)

(72) Inventors: Ryan Robert Bellinger, St. Joseph, MI (US); Jesse De Freitas Goncalves, Stevensville, MI (US)

(73) Assignee: Whirlpool Corporation, Benton Harbor, MI (US)

( * ) Notice: Subject to any disclaimer, the term of this patent is extended or adjusted under 35 U.S.C. 154(b) by 755 days.

(21) Appl. No.: 18/119,328

(22) Filed: Mar. 9, 2023

(65) Prior Publication Data

US 2024/0301615 A1 Sep. 12, 2024

(51) Int. Cl.

| | |
|---|---|
| ***D06F 58/22*** | (2006.01) |
| ***D06F 34/18*** | (2020.01) |
| ***D06F 34/20*** | (2020.01) |
| ***D06F 58/20*** | (2006.01) |
| ***D06F 58/26*** | (2006.01) |
| ***D06F 58/36*** | (2020.01) |

(Continued)

(52) U.S. Cl.

CPC ..... *D06F 58/22* (2013.01); *D06F 34/18* (2020.02); *D06F 34/20* (2020.02); *D06F 58/203* (2013.01); *D06F 58/26* (2013.01); *D06F 58/44* (2020.02); *D06F 2103/08* (2020.02); *D06F 2103/42* (2020.02); *D06F 2103/54* (2020.02); *D06F 2105/12* (2020.02); *D06F 2105/28* (2020.02); *D06F 2105/30* (2020.02); *D06F 2105/40* (2020.02); *D06F 2105/52* (2020.02); *D06F 2105/58* (2020.02)

(58) Field of Classification Search

CPC ..... D06F 58/22; D06F 58/44; D06F 58/38; D06F 58/36; D06F 58/203

USPC ..... 34/82, 85, 339, 350; 55/490

See application file for complete search history.

(56) References Cited

U.S. PATENT DOCUMENTS 3,402,576 A * 9/1968 Krupsky ..... D06F 23/02 68/12.22

6,793,685 B2 9/2004 Noyes et al.

(Continued)

FOREIGN PATENT DOCUMENTS

DE 102014118861 A1 6/2016

DE 102018219361 A1 * 5/2020 ..... D06F 58/34

OTHER PUBLICATIONS

English DE102018219361 by PE2E Oct. 6, 2025.*

*Primary Examiner* — Deming Wan

(74) *Attorney, Agent, or Firm* — Price Heneveld LLP

(57) ABSTRACT

A laundry appliance includes a drum that defines a processing space for drying articles. A blower delivers process air through an airflow path that includes the processing space. A heater is in thermal communication with the airflow path and delivers thermal energy to the process air. A controller is in communication with the drum, the blower, and the heater. During operation of a laundry cycle, the heater, the drum, and the blower cooperatively operate a particulate removal phase that maintains the articles in a damp state for a predetermined period of time. The damp state of the articles prevents accumulation of an electrostatic charge within the articles and a surface of the drum and allows the process air to separate particulate matter from the articles. After completion of the particulate removal phase, the heater operates at a conventional state that operates to dry the articles.

20 Claims, 12 Drawing Sheets

(51) Int. Cl.

| | |
|---|---|
| ***D06F 58/38*** | (2020.01) |
| ***D06F 58/44*** | (2020.01) |
| *D06F 103/08* | (2020.01) |
| *D06F 103/42* | (2020.01) |
| *D06F 103/54* | (2020.01) |
| *D06F 105/12* | (2020.01) |
| *D06F 105/28* | (2020.01) |
| *D06F 105/30* | (2020.01) |
| *D06F 105/40* | (2020.01) |
| *D06F 105/52* | (2020.01) |
| *D06F 105/58* | (2020.01) |

(56) References Cited

U.S. PATENT DOCUMENTS

| | | | | |
|---|---|---|---|---|
| 7,565,822 | B2 * | 7/2009 | Park | D06F 39/40 68/207 |
| 8,844,160 | B2 | 9/2014 | Beihoff et al. | |
| 8,863,403 | B2 | 10/2014 | Lee et al. | |
| 9,194,076 | B2 | 11/2015 | Son et al. | |
| 9,267,229 | B2 | 2/2016 | Oh et al. | |
| 10,738,411 | B2 | 8/2020 | Civanelli et al. | |
| 11,015,281 | B2 * | 5/2021 | Grider | D06F 39/10 |
| 11,299,834 | B2 | 4/2022 | Civanelli et al. | |
| 11,519,128 | B2 | 12/2022 | Miranda Razo | |
| 2006/0016020 | A1 * | 1/2006 | Park | D06F 39/40 68/5 R |
| 2007/0227030 | A1 * | 10/2007 | Oh | D06F 58/44 34/597 |
| 2008/0307667 | A1 * | 12/2008 | Ikemizu | D06F 58/203 34/132 |
| 2020/0238202 | A1 * | 7/2020 | Renz | B01D 29/09 |
| 2021/0095418 | A1 * | 4/2021 | Masters | D06F 58/30 |

* cited by examiner

PARTICULATE REMOVAL SYSTEM FOR LAUNDRY DRYING APPLIANCES

BACKGROUND OF THE DISCLOSURE

The present disclosure generally relates to laundry appliances, and more specifically, to a foreign particulate collector for a laundry appliance.

SUMMARY OF THE DISCLOSURE

According to one aspect of the present disclosure, a laundry appliance includes a drum that rotates about a rotational axis and defines a processing space for drying articles therein. A blower delivers process air through an airflow path that includes the processing space. A heater is in thermal communication with the airflow path. The heater operates to deliver thermal energy to the process air. A controller is in communication with the drum, the blower, and the heater, wherein during operation of a laundry cycle, the heater, the drum, and the blower cooperatively operate a particulate removal phase that maintains the articles in a damp state for a predetermined period of time. The damp state of the articles prevents accumulation of an electrostatic charge within the articles and a surface of the drum and further allows the process air to separate particulate matter from the articles. After completion of the particulate removal phase, the heater operates at a conventional state that operates to dry the articles.

According to another aspect of the present disclosure, a laundry appliance includes a blower that delivers process air through an airflow path that includes a processing space. A heater is in thermal communication with the airflow path. The heater operates to deliver thermal energy to the process air. A fluid delivery system selectively directs a flow of process fluid into the processing space. A moisture sensor monitors a moisture content present within the processing space. A controller is in communication at least with the heater, the fluid delivery system and the moisture sensor, wherein during operation of a laundry cycle, the heater, the blower, and the fluid delivery system cooperatively operative a particulate removal phase that maintains articles in a damp state for a predetermined period of time. The damp state of the articles is monitored by the moisture sensor and prevents accumulation of an electrostatic charge within the processing space, and further allows the process air to separate particulate matter from the articles. Upon completion of the particulate removal phase, the heater operates at a conventional state that operates to dry the articles.

According to yet another aspect of the present disclosure, a method for separating particulate from articles includes the steps of saturating articles within a processing space with process fluid, activating a blower and a heater to deliver heated process air and unheated process air through the processing space, monitoring a moisture content within the processing space using a moisture sensor, maintaining the moisture content within the processing space to be within a desired moisture range to prevent accumulation of electrostatic charges between particulate matter and the articles within the processing space, separating the particulate matter from the articles using the heated process air and the unheated process air while the moisture content is within the desired moisture range, and activating a conventional drying operation to dry the articles.

These and other features, advantages, and objects of the present disclosure will be further understood and appreciated by those skilled in the art by reference to the following specification, claims, and appended drawings.

Figure 1:
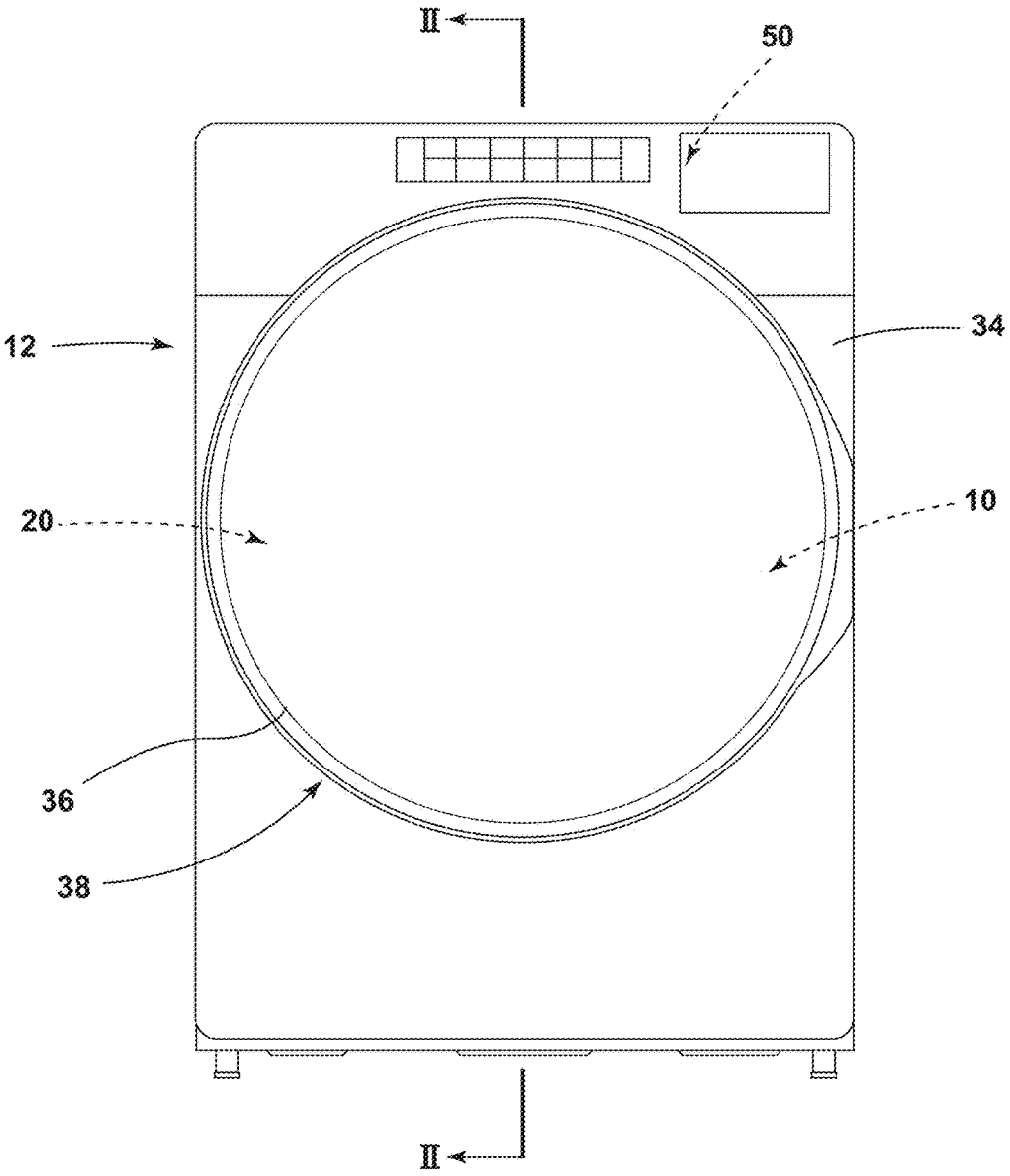
FIG. 1 is a front elevation view of an appliance that incorporates an aspect of the particulate removal system.

The components in the figures are not necessarily to scale, emphasis instead being placed upon illustrating the principles described herein.

DETAILED DESCRIPTION

The present illustrated embodiments reside primarily in combinations of method steps and apparatus components related to a laundry appliance that incorporates a particulate removal system that maintains a moisture level of a processing space within a desired moisture range for preventing the accumulation of electrostatic charges between particulate matter and articles being processed within the processing space. Accordingly, the apparatus components and method steps have been represented, where appropriate, by conventional symbols in the drawings, showing only those specific details that are pertinent to understanding the embodiments of the present disclosure so as not to obscure the disclosure with details that will be readily apparent to those of ordinary skill in the art having the benefit of the description herein. Further, like numerals in the description and drawings represent like elements.

For purposes of description herein, the terms "upper," "lower," "right," "left," "rear," "front," "vertical," "horizontal," and derivatives thereof shall relate to the disclosure as oriented in FIG. 1. Unless stated otherwise, the term "front" shall refer to the surface of the element closer to an intended viewer, and the term "rear" shall refer to the surface of the element further from the intended viewer. However, it is to be understood that the disclosure may assume various alternative orientations, except where expressly specified to the contrary. It is also to be understood that the specific devices and processes illustrated in the attached drawings, and described in the following specification are simply exemplary embodiments of the inventive concepts defined in the appended claims. Hence, specific dimensions and other physical characteristics relating to the embodiments disclosed herein are not to be considered as limiting, unless the claims expressly state otherwise.

The terms "including," "comprises," "comprising," or any other variation thereof, are intended to cover a non-exclusive inclusion, such that a process, method, article, or apparatus that comprises a list of elements does not include only those elements but may include other elements not expressly listed or inherent to such process, method, article, or apparatus. An element preceded by "comprises a . . . " does not, without more constraints, preclude the existence of additional identical elements in the process, method, article, or apparatus that comprises the element.

Figure 2:
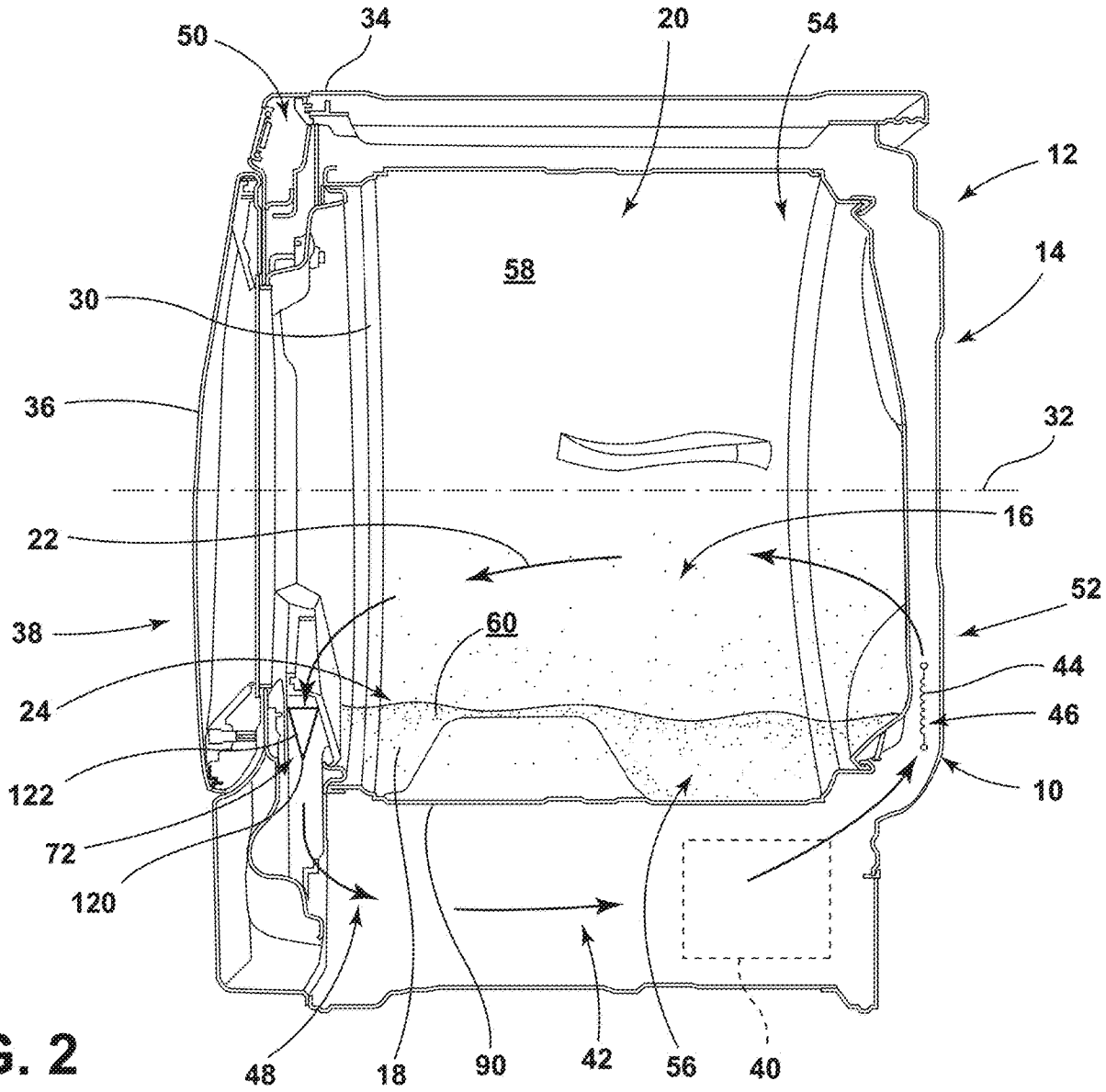
FIG. 2 is a cross-sectional view of a recirculation-type drying appliance that incorporates an aspect of the particulate removal system.
Figure 3:
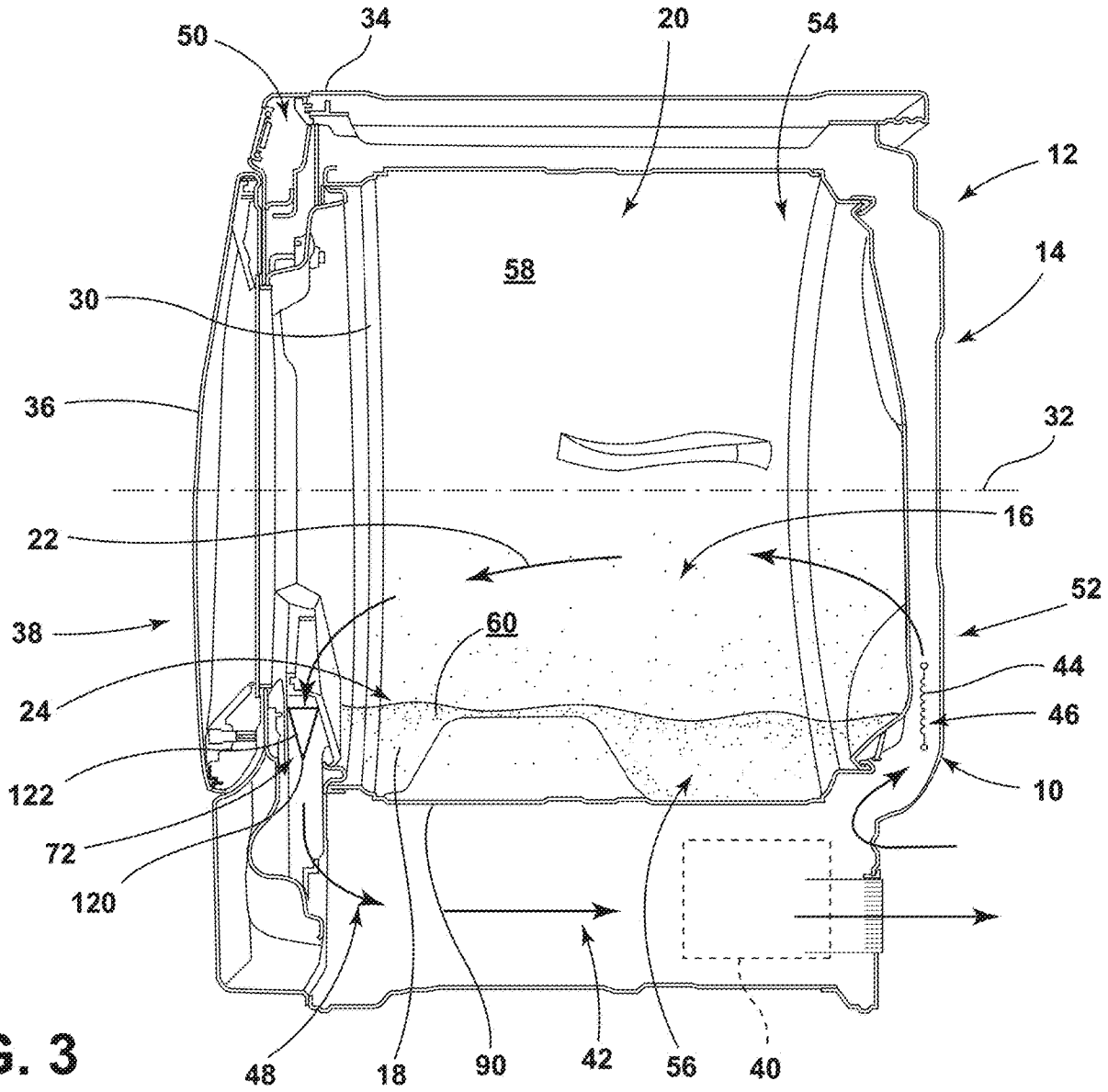
FIG. 3 is a cross-sectional view of an exhaust-type drying appliance that incorporates an aspect of the particulate removal system.

Referring to FIGS. 1-8, reference numeral 10 generally designates a particulate removal system that is incorporated within a laundry appliance 12 having a drying function 14. This appliance 12 can be in the form of a dryer, combination washer and dryer, recirculating drying appliance (as shown in FIG. 2), exhaust-type drying appliance (as shown in FIG. 3), refreshing appliance, and other similar appliances that incorporate a drying function 14. It is also contemplated that a particulate removal system 10 can be incorporated within non-laundry appliances 12 that can include, but are not limited to, dishwashers, air handling systems, and other similar appliances that seek to prevent the accumulation of particulate matter 16 within a particular space. According to various aspects of the device, the particulate removal system 10 is incorporated within the appliance 12 to separate particulate matter 16, typically in the form of pet hair, lint, and other particles, from articles 18 being processed within a processing space 20 of the appliance 12. This is accomplished through the movement of process air 22 through the processing space 20, while also preventing the accumulation of electrostatic charges 24 within the processing space 20 and within the articles 18 being processed therein, as will be described more fully below.

According to various aspects of the device, as exemplified in FIGS. 1-8, the laundry appliance 12 includes a drum 30 that rotates about a rotational axis 32 and defines the processing space 20 for drying articles 18 therein. The drum 30 is typically positioned within an outer cabinet 34 that includes a door 36 that can move to an open position to provide access into the processing space 20 within the drum 30. The door 36 can also be moved to a closed position 38 for enclosing the processing space 20 so that process air 22 can effectively move therethrough for processing articles 18 contained within the processing space 20. A blower 40 is positioned within the outer cabinet 34 that delivers process air 22 through an airflow path 42 that includes the processing space 20. A heater 44 is in thermal communication with the airflow path 42. The heater 44 operates to deliver thermal energy 46 to the airflow path 42 and the process air 22 moving therethrough. This heater 44 delivers the thermal energy 46 to the process air 22 to define heated process air 48 that is then delivered to the processing space 20.

A controller 50 is in communication with the drum 30, the blower 40, and the heater 44. During operation of a laundry cycle 54, the heater 44, the drum 30, and the blower 40 cooperatively operate a particulate removal phase 52 of a laundry cycle 54 that maintains the articles 18, and the processing space 20 within the drum 30, in a damp state 56. The particulate removal phase 52 is typically operated for a predetermined period of time. The damp state 56 of the articles 18 prevents accumulation of electrostatic charges 24 within the articles 18 and between particulate matter 16 and the articles 18. The damp state 56 also prevents the accumulation of electrostatic charges 24 on an inner surface 58 of the drum 30 that defines the processing space 20. Using the damp state 56 of the articles 18, the process air 22 can flow across and around the articles 18 to separate particulate from the articles 18. In the absence of a significant amount of electrostatic charge, or the absence of electrostatic charge, the process air 22 is able to pass over and through the articles 18 being processed and is able to separate the particulate matter 16 from the outer surface 60 of the articles 18. After completion of the particulate removal phase 52, the heater 44 operates at a conventional state 62 that operates to dry the articles 18 within the processing space 20.

Referring again to FIGS. 1-8, the particulate removal phase 52 operates to maintain the processing space 20 at a particular moisture level or moisture range 70 for an extended period of time. During this extended period of time, the process air 22 moving through the processing space 20 is able to push, direct, or otherwise bias the particulate matter 16 away from the outer surface 60 of the articles 18 and toward a filtration system 72 positioned within the airflow path 42. It is contemplated that during the operation of the particulate removal phase 52, the articles 18 are dried only partially such that air is able to effectively pass around and through the articles 18 for engaging the particulate matter 16. To perform this partial drying operation, the heater 44 can operate at a low-power setting such that the heated process air 48 is only slightly warmer than unheated process air 74 that can be directed through the airflow path 42. To accomplish this minimally heated process air 48, the heater 44 can operate at a low-power setting, such as 50% power, or within a range of from approximately 20% power to approximately 80% power. It is contemplated that the heater 44 can alternate between an activated state and a deactivated state to operate intermittently at a full-power setting or at a low-power setting or off setting. In such an aspect of the device, the blower 40 can cooperate with the heater 44 to alternatively deliver heated process air 48 and unheated process air 74 to the processing space 20.

According to the various aspects of the device, the moisture range 70 that can be maintained during performance of the particulate removal phase 52 can be between approximately 80% to approximately 30%. The moisture range 70 can also be from between approximately 90% to approximately 20%. It should be contemplated that the configuration and specific values of the moisture range 70 can vary depending on several factors. Such factors can include, but are not limited to, the type of fabric being processed, the type of articles 18 being processed, the amount of articles 18 being processed, the composition of the process fluid 102, whether the operation is a first particulate removal phase 52 or a subsequent particulate removal phase 52, combinations of these factors and other similar factors.

During the performance of a particulate removal phase 52, the particulate matter 16 generally becomes at least partially dried. In this manner, these particles having some moisture content 80 can lose the electrostatic charge. Also, with the removal of a portion of the moisture content 80, these particles can become light enough to be moved through the passage of process air 22 through the processing space 20. The articles 18 being processed remain in the damp state 56 and have sufficient moisture retained therein to a level that is within the desired moisture range 70. In this desired moisture range 70, electrostatic charges 24 are unable to form, or can be discharged, between the particulate matter 16 and the articles 18 being processed. In this manner, the lighter and mostly dried or completely dried particulate matter 16 is moved by the process air 22 through the filtration system 72. At the same time, the articles 18 being processed remain in the damp state 56, as discussed herein, during the performance of the particulate removal phase 52.

According to various aspects of the device, it is contemplated that the particulate removal phase 52 can be designed to last a predefined amount of time. This amount of time can be within a range of from approximately 10 minutes to approximately 2 hours, and any range of times less than 10 minutes, greater than 2 hours or ranges of time therebetween. At the conclusion of the particulate removal phase 52 having a predetermined amount of time, the user can be prompted to check the articles 18 and assess whether a subsequent particulate removal phase 52 should be initiated, or whether the laundry cycle 54 should be completed and the articles 18 dried to the desired dryness level, which can be described as a conventional state 62 of the laundry cycle 54.

Figure 4:
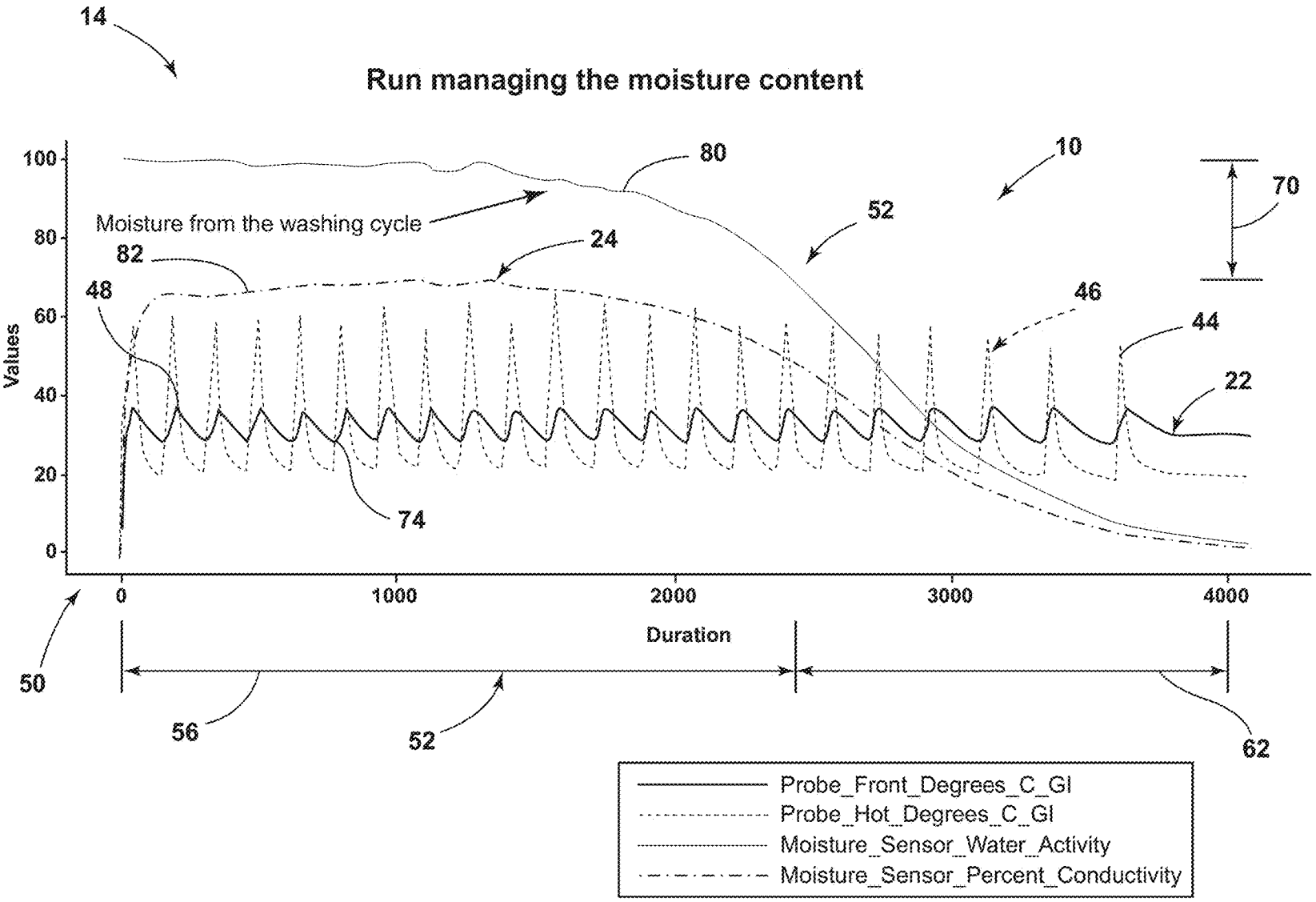
FIG. 4 is a schematic diagram illustrating operation of various components of the appliance for performing a particulate removal phase of a drying appliance.
Figure 5:
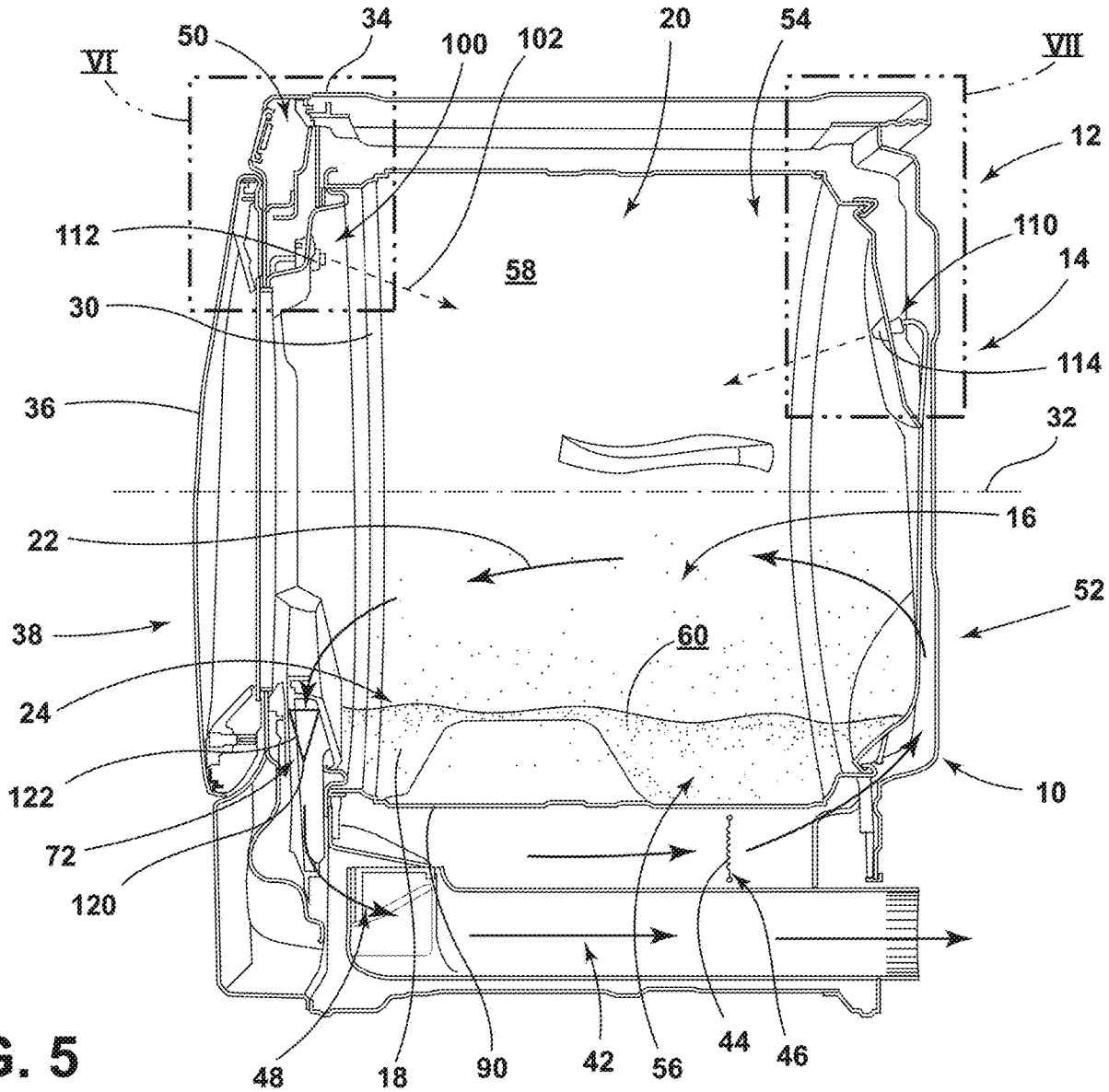
FIG. 5 is a cross-sectional view of an exhaust-type drying appliance that incorporates a fluid delivery system for delivering process fluid into a processing space to perform an aspect of the particulate removal phase of a laundry cycle.
Figure 6:
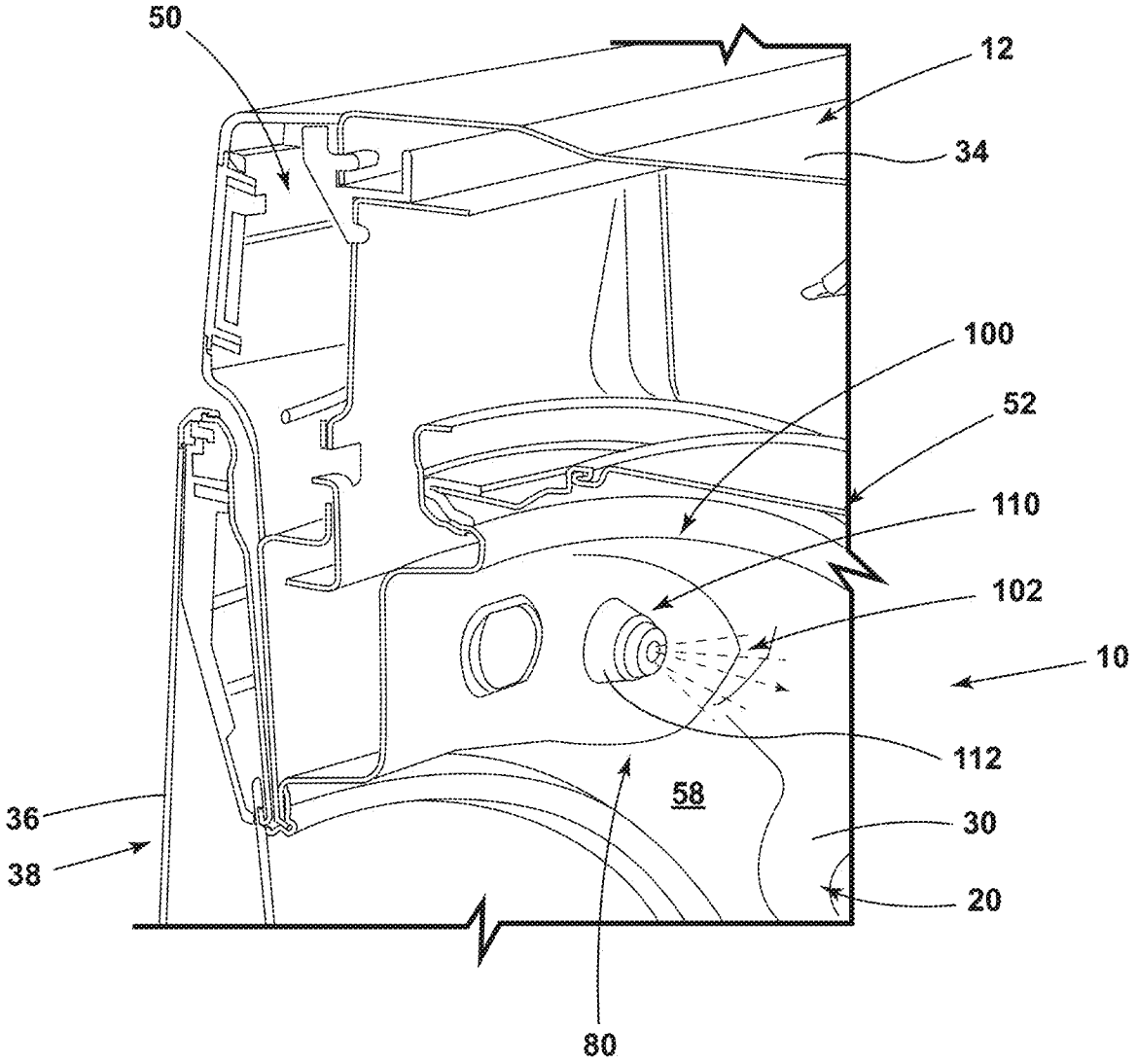
FIG. 6 is an enlarged cross-sectional perspective view of the appliance of FIG. 5 taken at area VI.
Figure 7:
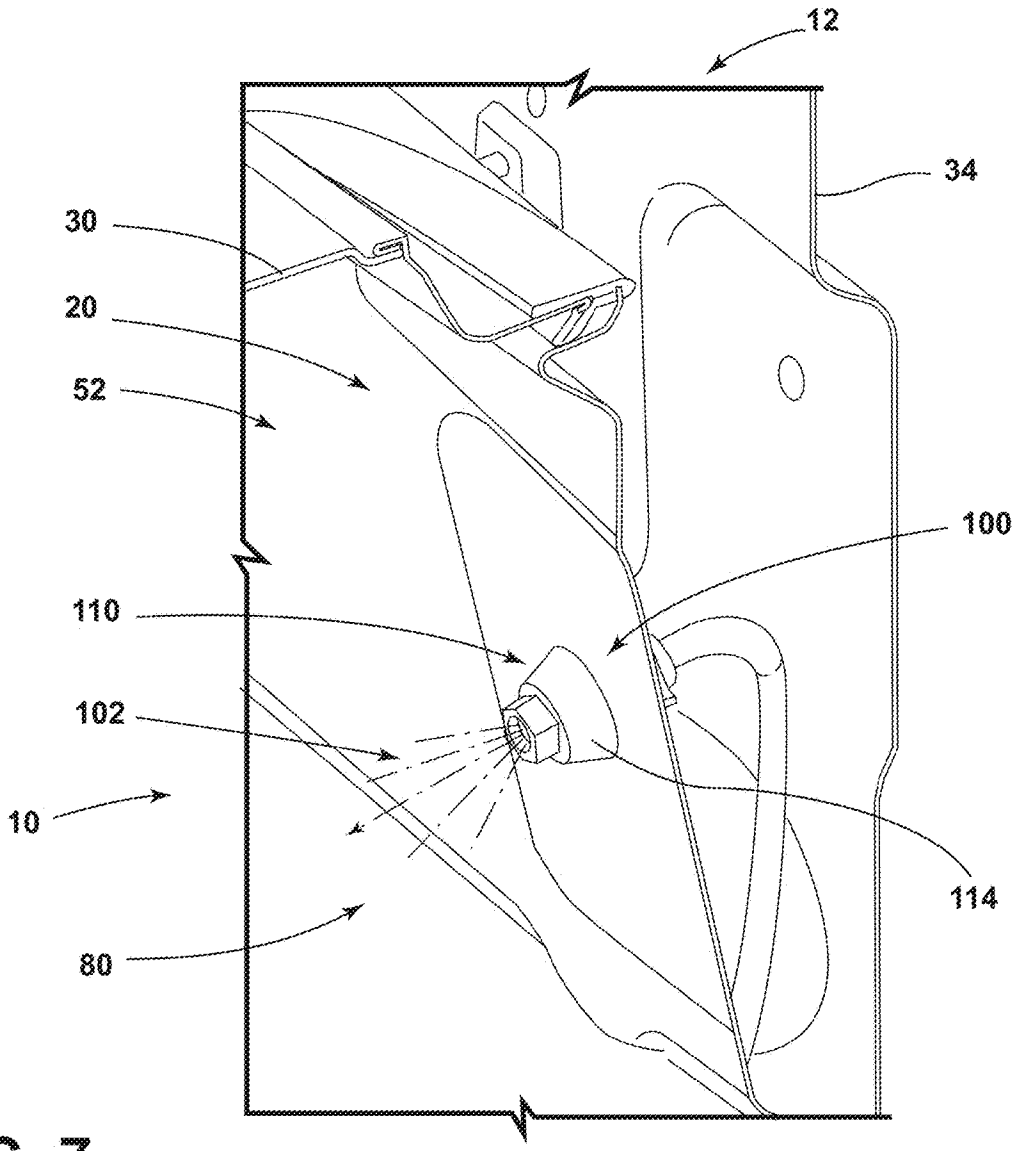
FIG. 7 is an enlarged cross-sectional view of the appliance of FIG. 5 taken at area VII.

Referring now to FIG. 4, the schematic diagram illustrates an exemplary performance of a particulate removal phase 52 of the laundry cycle 54. As shown within FIG. 4, the moisture content 80 of the articles 18 remains significantly high and within the desired moisture range 70 for an extended period of time. Simultaneously, the heater 44 activates in an intermittent cycle to alternatively deliver a heated process air 48 and unheated process air 74 to the processing space 20. Through this delivery of heated process air 48 and unheated process air 74, the conductivity 82 of the articles 18 being processed remains within a state where electrostatic charges 24 are unable to accumulate, or, if present, are at least partially discharged. During this stage, the particulate matter 16 is conducive to being removed from the articles 18 through the passage of process air 22 through the processing space 20. At the same time, the heat of the process air 22 moving through the processing space 20 is quickly elevated, then cooled for a period of time, and quickly elevated again. This repeated process of applying heated process air 48 and unheated process air 74 continues through the particulate removal phase 52.

Referring again to FIG. 4, it is contemplated that at the completion of the particulate removal phase 52, the heater 44 can continue to operate in the repeated system of heating to provide heated process air 48 and then deactivating for providing unheated process air 74. The timeframe at which these repeated activations and deactivations of the heater 44 operation can change as the appliance 12 enters the conventional state 62 of the laundry cycle 54. Through this extension of time at which the articles 18 remain within this damp state 56 extends the time allotted for the process air 22 to remove the particulate matter 16 from these articles 18 being processed.

Referring again to FIGS. 1-8, the laundry appliance 12 can include a moisture sensor 90, typically in the form of a conductivity sensor. The controller 50 is in communication with this moisture sensor 90, as well as the heater 44. The controller 50, in response to moisture measurements from the moisture sensor 90, operates the heater 44 to maintain the articles 18 in the damp state 56. Accordingly, the moisture sensor 90 and the controller 50 cooperate to extend the time period within which the articles 18 are maintained in the damp state 56. If the moisture sensor 90 measurements indicate that the articles 18 are being dried too fast, the moisture sensor 90 and the controller 50 can cooperate to activate and deactivate the heater 44 to space apart the activations to be farther apart. The controller 50 can also instruct the heater 44 to activate a lower intensity such that the heated process air 48 provided during the particulate removal phase 52 is delivered at a lower temperature through the processing space 20. Conversely, where the articles 18 are being dried too slowly, or the articles 18 are being maintained at a moisture level that is above the desired moisture range 70, the moisture sensor 90 and the controller 50 can operate the heater 44 to activate more frequently or to activate at a higher percentage efficiency to increase the temperature of the heated process air 48 being delivered to the processing space 20.

Referring now to FIGS. 5-8, the appliance 12 can include a fluid delivery system 100 that directs a flow of process fluid 102 into the processing space 20. This fluid delivery system 100 is typically in communication with the controller 50 and can also be in communication with the moisture sensor 90 and other components of the appliance 12. During operation, when the moisture sensor 90 senses that the articles 18 are being dried too quickly, as sensed by the moisture sensor 90, the moisture sensor 90 can send a signal to the controller 50 regarding this condition. The controller 50 can then activate the fluid delivery system 100 for adding process fluid 102 to the processing space 20 that can be saturated into the articles 18 being processed for increasing the moisture content 80 within the articles 18 and the processing space 20 as a whole. It is contemplated that this process fluid 102 delivered through the fluid delivery system 100 can be a spray of process fluid 102, fine droplets or a fluid mist of process fluid 102, or steam that is directed into the processing space 20. This addition of process fluid 102 to increase the moisture content 80 within the processing space 20 can be repeated a predetermined number of times to extend the time period through which the particulate removal phase 52 can be performed.

Figure 8:
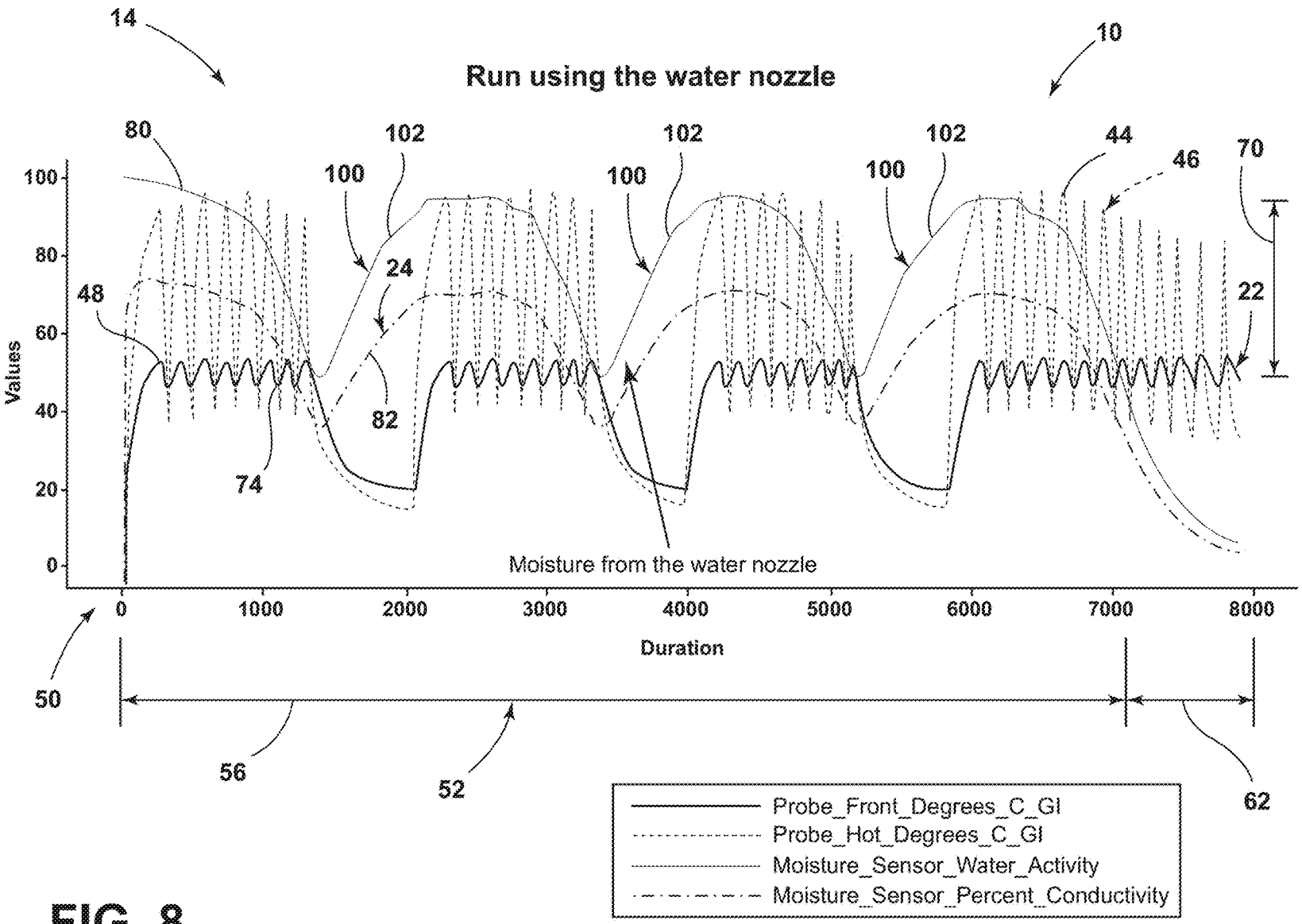
FIG. 8 is a schematic diagram illustrating operation of various components of the appliance for performing a lint removal phase of a drying cycle that incorporates the fluid delivery system.
Figure 9:
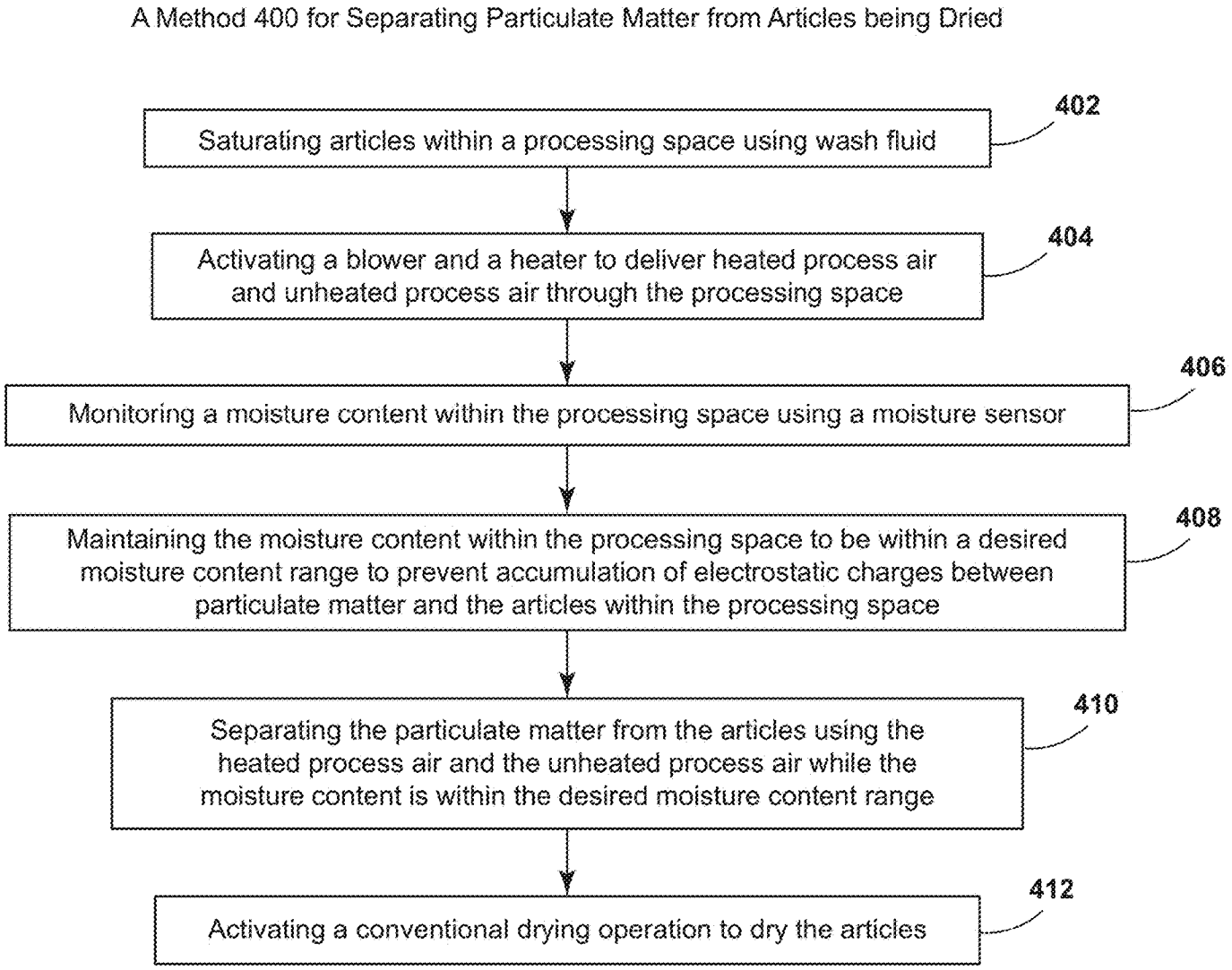
FIG. 9 is a linear flow diagram illustrating a method for removing particulate from a processing space.
Figure 10:
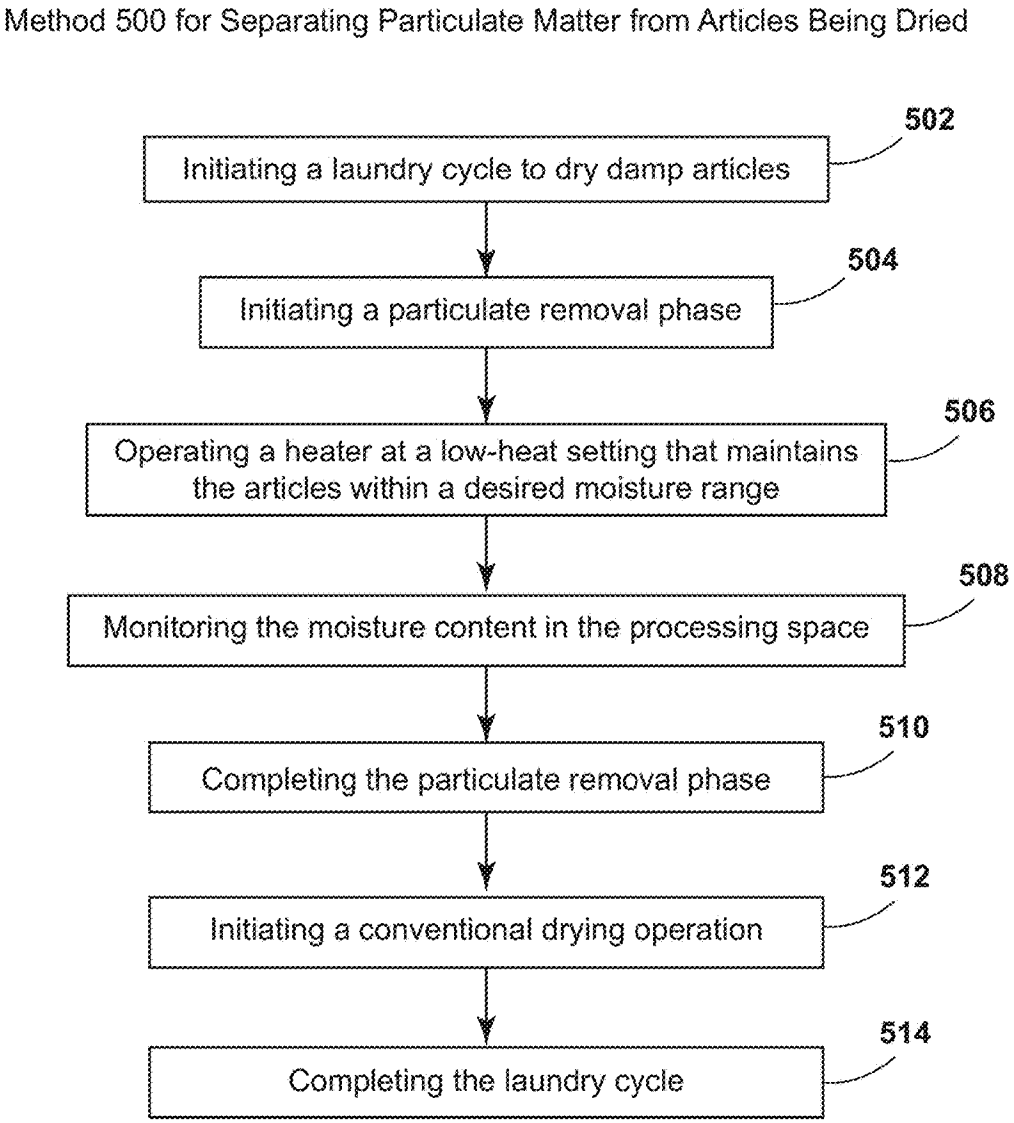
FIG. 10 is a linear flow diagram illustrating a method for removing particulate from a processing space.
Figure 11:
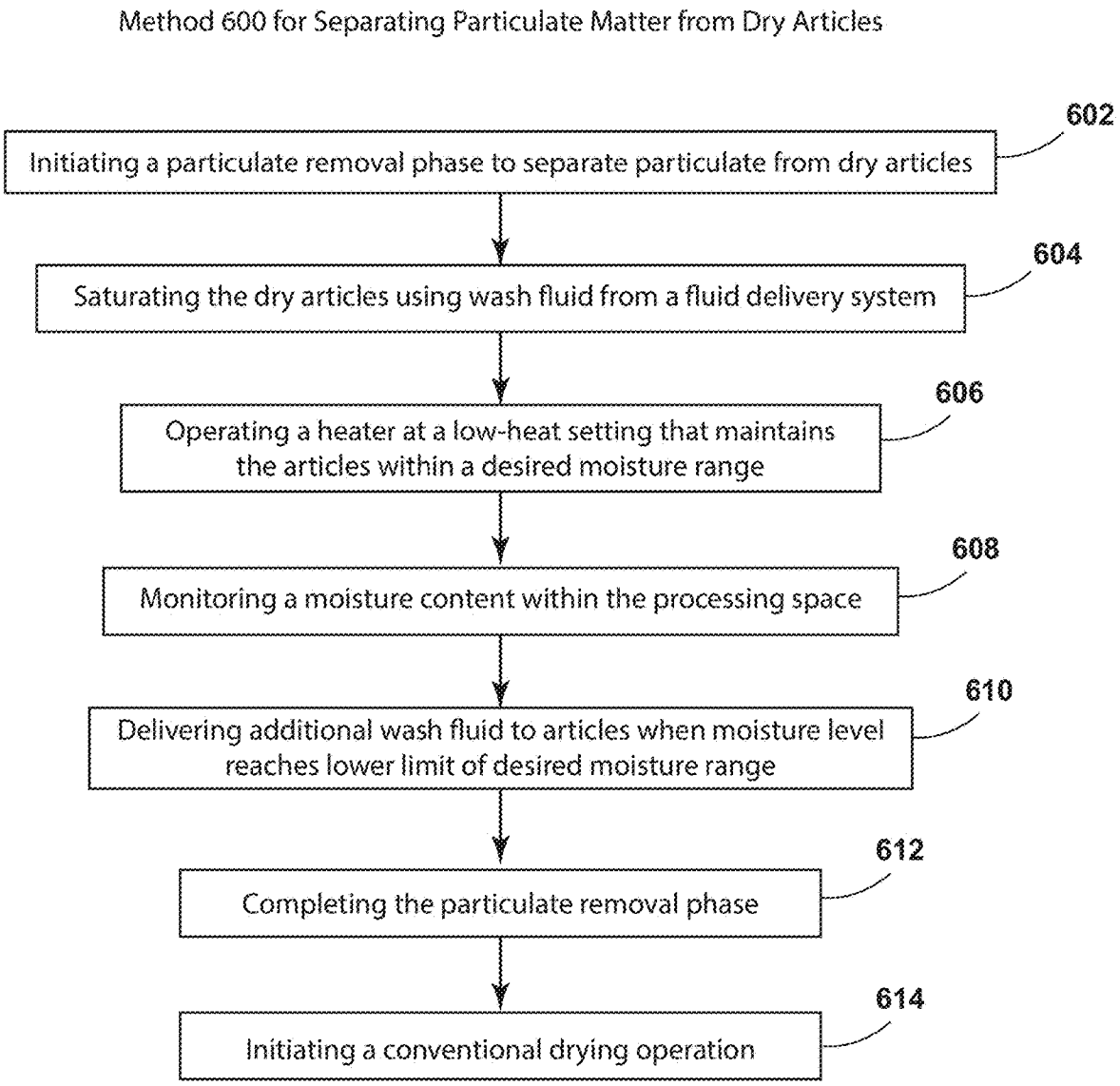
FIG. 11 is a linear flow diagram illustrating a method for removing particulate from a processing space.
Figure 12:
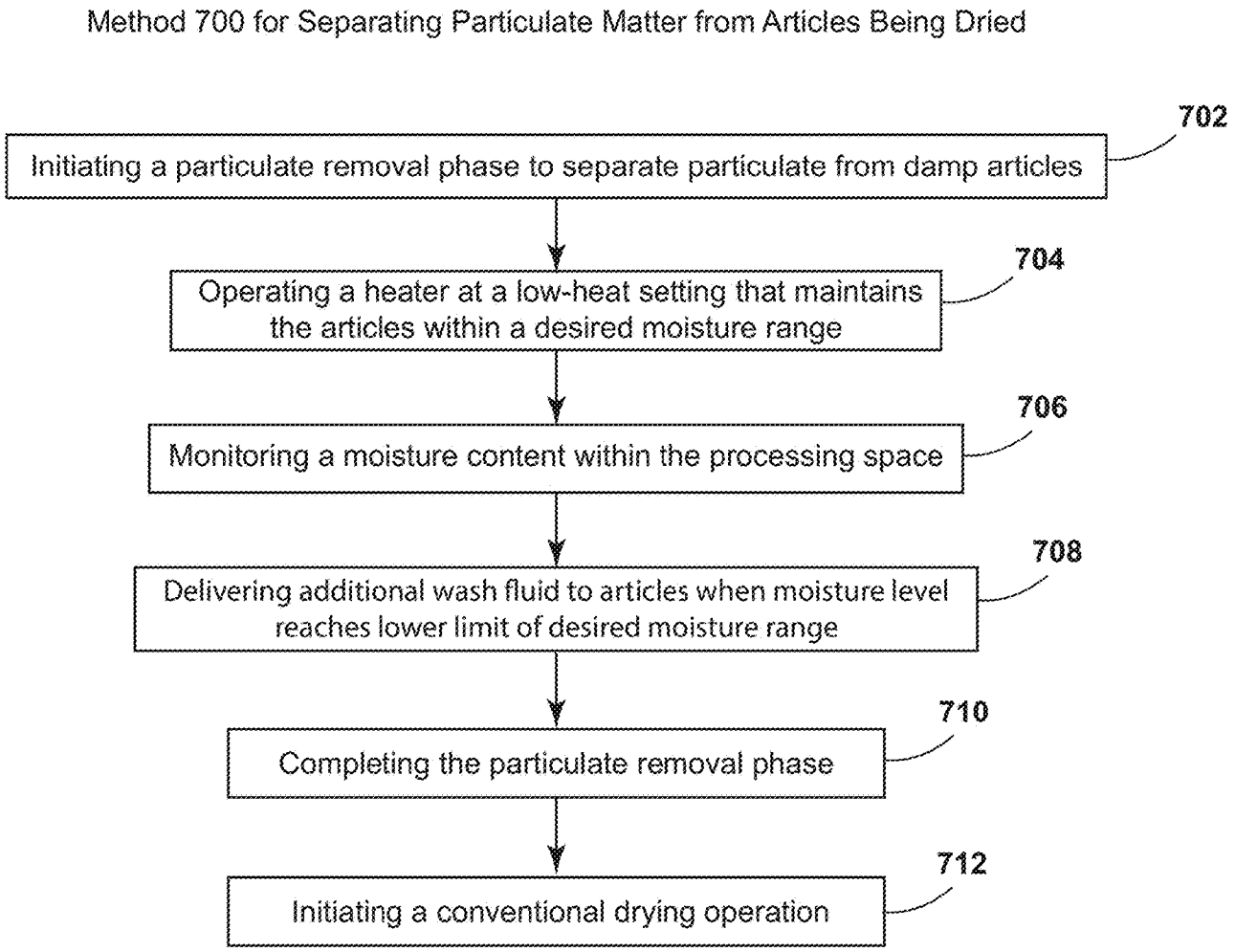
FIG. 12 is a linear flow diagram illustrating a method for removing particulate from a processing space.

Referring now to FIG. 8, in certain aspects of the particulate removal phase 52, the heater 44 is activated intermittently to provide, alternatively, heated process air 48 and unheated process air 74 to the processing space 20. During the course of the particulate removal phase 52, the moisture content 80 of the articles 18 and the processing space 20 is decreased. When the moisture content 80 approaches or falls below the desired moisture content 80, the moisture sensor 90 and the controller 50 cooperate to activate the fluid delivery system 100 for delivering process fluid 102 into the processing space 20 for saturating the articles 18 being processed. The moisture content 80 and the percent of conductivity 82 also increase so that electrostatic charges 24 are prevented from forming. Additionally, electrostatic charges 24 that may have formed between the particulate matter 16 and the articles 18 can be discharged or otherwise eliminated through the application of the process fluid 102 into the processing space 20. In certain aspects of the device, the process fluid 102 can include certain chemistries or additives that include an anti-static fluid or a static mitigating fluid. These additives can be used to further mitigate or further eliminate static charges within the processing space 20.

During the delivery of the process fluid 102 into the processing space 20, it is contemplated that the heater 44 can be deactivated until such time as dispensing of the process fluid 102 is complete. It is also contemplated that the blower 40 can also be deactivated during this application of process fluid 102 to prevent process fluid 102 from being blown by the process air 22 toward certain sections of the processing space 20 and away from other portions of the processing space 20. This can be done to ensure that the process fluid 102 is distributed throughout the articles 18 of clothing to achieve even and consistent saturation of the process fluid 102 within the articles 18. Throughout this particulate removal phase 52, it is contemplated that the drum 30 can continue to rotate to ensure proper saturation of the articles 18 within the drum 30.

In certain aspects of the device, it is contemplated that the blower 40 can remain active and can be used to deliver unheated process air 74 through the processing space 20. Throughout this process, it is contemplated that the moisture sensor 90, again, typically in the form of a conductivity sensor is continuously in communication with the processing space 20 to measure the moisture content 80 and/or percent of or level of conductivity 82 of the articles 18 being processed, as well as the processing space 20 in general. The readings of the moisture sensor 90 allow the controller 50 to ascertain when the process fluid 102 should be added to the processing space 20 for increasing the moisture content 80.

Referring again to FIGS. 5-7, it is contemplated that the appliance 12 can include a single nozzle that delivers process fluid 102 into the processing space 20. The fluid delivery system 100 can also include a plurality of nozzles 110 that cooperatively deliver the process fluid 102 into the processing space 20. As exemplified in FIGS. 5-7, the appliance 12 includes a front nozzle 112 and a rear nozzle 114 that cooperatively deliver the process fluid 102 into the processing space 20. As described herein, these nozzles 110 can be used to deliver a stream of process fluid 102, a fluid mist of process fluid 102, or other form of spray pattern of the process fluid 102. It is contemplated that the appliance 12 can include a steam generator that converts the process fluid 102 to steam that is then delivered into the laundry appliance 12. This steam can be generated through the use of a heating element or other similar electrical device that can convert process fluid 102 into steam. It is also contemplated that the laundry appliance 12 can include a dew point-based system that produces steam through the use of differentiations in dew points within the processing space 20 and outside the processing space 20. This application of steam using a dew-point based mechanism can be used to prevent the application of additional thermal energy 46 into the processing space 20, while also saturating the articles 18 with the process fluid 102 to maintain the articles 18 within the damp state 56. The application of additional thermal energy 46 may result in a premature or unwanted amount of drying of the articles 18 within the processing space 20.

Referring again to FIGS. 5-8, where the appliance 12 includes the fluid delivery system 100 that delivers process fluid 102 into the processing space 20, it is contemplated that dry clothing can be placed within the processing space 20 at the beginning of a stand-alone particulate removal phase 52. The fluid delivery system 100, via the nozzles 110, can be used to saturate the articles 18 to reach the desired moisture content 80. Once the articles 18 are saturated to the appropriate moisture range 70 that is indicative of the damp state 56, it is contemplated that the remainder of the particulate removal phase 52 can be operated to maintain the articles 18 within this desired moisture range 70, and also use process air 22 for separating particulate matter 16 from the articles 18, as described herein.

As described herein, the various aspects of the particulate removal system 10 are used to maintain the moisture content 80 of the articles 18 within a particular moisture range 70. At the same time, particulate matter 16 that are in generally constant contact with the process air 22, are able to dry to a higher degree. These particles can then be moved, via the movement of process air 22, to a filtration system 72 within the airflow path 42 of the appliance 12.

According to various aspects of the device, a particulate filter 120 is positioned within the airflow path 42. Over the course of a particulate removal phase 52, this particulate filter 120, which typically includes a mesh screen 122, captures the separated particulate matter 16 from the articles 18.

In certain aspects of the device, the particulate filter 120 can include a particulate sensor. The particulate sensor operates to measure the amount of particulate that is captured within the mesh screen 122 of a particulate filter 120. This particulate sensor can be an optical sensor that measures the amount of captured particulate. It is also contemplated that the particulate sensor can be in the form of a current sensor that measures an amount of current drawn by a motor for the blower 40 when the blower 40 operates to move the process air 22 through the airflow path 42. Using this current sensor, when the blower 40 is met with increased resistance due to the accumulation of particulate matter 16 on the mesh screen 122 blocking process air 22 through the particulate filter 120, the current drawn will increase. This increase in the drawn current is able to be monitored by the current sensor. Other particulate sensors can be used for monitoring the amount of particulate matter 16 that is accumulated on to the mesh screen 122 of a particulate filter 120.

When the particulate sensor is used, this particulate sensor will be in communication with the controller 50. When the particulate sensor measures that the mesh screen 122 has a high amount of particulate matter 16 that is blocking movement of process air 22 through the airflow path 42, the user can be alerted that the lint screen may need to be removed and cleaned. It is also contemplated that the particulate filter 120 can be used to measure the effectiveness of the particulate removal phase 52. In such an aspect of the device, where the amount of particulate captured does not increase over a particular period of time, the particulate removal phase 52 can be shortened due to the fact that particulate is no longer being separated and captured by the particulate filter 120. Conversely, when the end of a particulate removal phase 52 is approaching and particulate matter 16 is still being captured at a steady rate, the particulate sensor can provide a signal to the controller 50 to extend operation of a particulate removal phase 52 to capture additional amounts of particulate matter 16 that appear to be present within the processing space 20 and on the articles 18 being processed. Accordingly, the moisture sensor 90, the particulate sensor, and the controller 50 can cooperate to determine whether to initiate a subsequent particulate removal phase 52, or to initiate the conventional state 62 of the laundry cycle 54 that completes drying to the desired dryness level.

In certain aspects of the device, when the appliance 12 is a combination washing and drying appliance, the particulate removal phase 52 can be initiated after a rinse cycle of the appliance 12 is completed. After the rinse cycle, the articles 18 within the processing space 20 will be within the damp state 56. As discussed herein, in this damp state 56, the particulate removal phase 52 can be operated to maintain the articles 18 within the desired moisture range 70 for separating particulate matter 16 from the articles 18. It is contemplated that at the conclusion of a rinse phase, the moisture content 80 of the articles 18 may be above the desired moisture range 70. In such an instance, the drying function 14 may activate in the conventional state 62 until the moisture content 80 is indicative of the damp state 56 of the articles 18 being processed. Once the damp state 56 is achieved, the particulate removal phase 52 can be activated.

Referring again to FIGS. 5-8, the laundry appliance 12 can include the blower 40 that delivers the process air 22 through the airflow path 42 that includes the processing space 20. The heater 44 is in thermal communication with the airflow path 42. The heater 44 operates to deliver thermal energy 46 to the process air 22 to define heated process air 48. The fluid delivery system 100 selectively directs a flow of process fluid 102 to the processing space 20. The moisture sensor 90 monitors the moisture content 80 present within the processing space 20. The controller 50 is in communication with at least the heater 44, the fluid delivery system 100, and the moisture sensor 90. During operation of the laundry cycle 54, the heater 44, the blower 40, and the fluid delivery system 100 cooperatively operate the particulate removal phase 52 that maintains the articles 18 in the damp state 56 for a predetermined period of time. The damp state 56 of the articles 18 is monitored by the moisture sensor 90 and prevents accumulation of the electrostatic charge within the processing space 20. The damp state 56 also allows the process air 22 to separate particulate matter 16 from the articles 18 due to the particulate matter 16 drying at a faster rate than the articles 18 within the processing space 20. The particulate matter 16 can then be separated from the articles 18 and captured within the filtration system 72 of the appliance 12.

Upon completion of the particulate removal phase 52, the heater 44 operates at the conventional state 62 that operates to dry the articles 18 to the desired dryness level. As discussed herein, the particulate removal phase 52 can be initiated at the beginning of the laundry cycle 54 or within a separate laundry cycle 54. In addition, the particulate removal phase 52 can be initiated when the articles 18 are placed into the processing space 20 to dry or when they are placed within the processing space 20 in the damp state 56.

Referring now to FIGS. 1-9, having described various aspects of the particulate removal system 10, a method 400 is disclosed for separating particulate matter 16 from articles 18 being dried. The method includes a step 402 that includes saturating articles 18 within a processing space 20 using process fluid 102. As described herein, this can be done within a separate washing appliance (e.g. standalone washing machine), or can be done within the drying appliance 12 that includes a fluid delivery system 100. Once the articles 18 are in the damp state 56, a blower 40 and a heater 44 are activated to deliver heated process air 48 and unheated process air 74 through the processing space 20 (step 404). The moisture content 80 within the processing space 20 is then monitored using the moisture sensor 90 (step 406). The moisture content 80 within the processing space 20 is also monitored and maintained to be within a desired moisture range 70 (step 408). This maintenance of the moisture content 80 to be within the desired moisture range 70 serves to prevent the accumulation of electrostatic charges 24 between a particulate matter 16 and the articles 18 within the processing space 20. This particulate matter 16 can then be separated from the articles 18 using the heated process air 48 and the unheated process air 74 while the moisture content 80 is within this desired moisture range 70 (step 410). After the particulate removal phase 52 is complete, the conventional drying operation is activated to dry the articles 18 to the desired dryness level (step 412).

Referring now to FIGS. 1-8 and 10, having described various aspects of the particulate removal system 10, a method 500 is disclosed for separating particulate matter 16 from articles 18 being processed. According to the method 500, a laundry cycle 54 is initiated to dry damp articles 18 (step 502). During the laundry cycle 54, a particulate removal phase 52 or sub-cycle is initiated (step 504). During the particulate removal phase 52, the heater 44 is operated at a low-power setting that maintains the articles 18 at the desired moisture level (step 506). The moisture level within the processing space 20 is monitored (step 508). As described herein, maintaining the processing space 20 within this desired moisture content 80 level assists in allowing the process air 22 to remove the particulate matter 16 from the articles 18. The particulate removal phase 52 is then completed (step 510). The conventional drying operation is then initiated (step 512). The laundry cycle 54 is then completed (step 514).

Referring now to FIGS. 5-8 and 11, having described various aspects of the particulate removal system 10, a method 600 is disclosed for separating particulate matter 16 from articles 18 being processed. According to the method 600, a particulate separating cycle (the particulate removal phase 52) is initiated to separate particulate from dry articles 18 within the processing space 20 (step 602). The articles 18 are saturated using a fluid delivery system 100 (step 604). A heater 44 is then operated at a low-power setting that maintains the articles 18 at the desired moisture range 70 (step 606). While the heater 44 is operated, the drum 30 is rotated and the blower 40 operates to deliver process air 22 through the processing space 20 contained within the drum 30 for processing the articles 18. The moisture level within the processing space 20 is monitored using a moisture sensor 90 (step 608). Through the course of the particulate removal phase 52, additional process fluid 102 is delivered to the articles 18 when the moisture content 80 reaches a lower limit of the desired moisture range 70 (step 610). When a particular timeframe has passed, or when a desired amount of particulate matter 16 has been removed, the particulate separating phase is determined to be completed by a controller 50 (step 612). The conventional state 62 of the drying operation is then initiated to dry the articles 18 to the desired dryness level (step 614).

Referring now to FIGS. 5-8 and 12, having described various aspects of the particulate removal system 10, a method 700 is disclosed for separating particulate matter 16 from articles 18 being processed. According to the method 700, a particulate separating phase is initiated to separate particulate matter 16 from articles 18 in a damp state 56 (step 702). A heater 44 is operated at a low-power setting that maintains the moisture content 80 of the articles 18 to be within a desired moisture range 70 (step 704). The moisture content 80 within the processing space 20 is monitored using a moisture sensor 90 (step 706). Additional process fluid 102 is delivered to the articles 18 when the moisture content 80 within the processing space 20 reaches a lower limit of the desired moisture range 70 (step 708). The particulate separating cycle is then completed when a desired amount of particulate matter 16 is removed from the articles 18, or when a predetermined amount of time has passed (step 710). The particulate removal phase 52 is then completed (step 712). It is contemplated that a particulate removal phase 52 can be a dedicated cycle that results in articles 18 being processed being dried to the desired dryness level.

According to various aspects of the device, a particulate removal system 10 operates to maintain the moisture content 80 of the articles 18 contained within the processing space 20 to be within a particular moisture range 70 to maintain the articles 18 within a damp state 56. When in this damp state 56, the process air 22 moving through the processing space 20 is better able to remove particulate matter 16 from the articles 18. This particulate matter 16 can then be delivered to a filtration system 72 of the appliance 12 so that the particulate matter 16 can be removed and disposed of. It is contemplated that the particulate removal system 10 is configured for use with particulate matter 16 that tends to have a higher electrostatic charge. Such particulate matter 16 can be in the form of pet hair, lint, and other similar articles 18 that tend to inherently possess an electrostatic charge. These particles tend to adhere easily to articles 18 being processed and can be difficult to remove from the articles 18 in conventional laundry cycles 54. The use of a particulate removal phase 52 is used to eliminate or at least minimize these electrostatic charges 24 so that the particles can be easily removed through the use of the process air 22 moving the processing space 20.

The invention disclosed herein is further summarized in the following paragraphs and is further characterized by combinations of any and all of the various aspects described therein.

According to one aspect of the present disclosure, a laundry appliance includes a drum that rotates about a rotational axis and defines a processing space for drying articles therein. A blower delivers process air through an airflow path that includes the processing space. A heater is in thermal communication with the airflow path. The heater operates to deliver thermal energy to the process air. A controller is in communication with the drum, the blower, and the heater, wherein during operation of a laundry cycle, the heater, the drum, and the blower cooperatively operate a particulate removal phase that maintains the articles in a damp state for a predetermined period of time. The damp state of the articles prevents accumulation of an electrostatic charge within the articles and a surface of the drum and further allows the process air to separate particulate matter from the articles. After completion of the particulate removal phase, the heater operates at a conventional state that operates to dry the articles.

According to another aspect, the particulate removal phase includes the heater operating at approximately 50% power.

According to another aspect, the particulate removal phase includes the heater operating intermittently. The blower cooperates with the heater to alternatively deliver heated process air and unheated process air to the processing space.

According to another aspect, at a completion of the particulate removal phase, the controller prompts a user to initiate one of a subsequent particulate removal phase and the conventional state of the laundry cycle.

According to another aspect, the laundry appliance further includes a moisture sensor. The controller is in communication with the moisture sensor and the heater. The controller, in response to moisture measurements from the moisture sensor, operates the heater to maintain the articles in the damp state.

According to another aspect, the laundry appliance further includes a fluid delivery system that directs a flow of process fluid into the processing space. The fluid delivery system is in communication with the controller and the moisture sensor.

According to another aspect, the fluid delivery system selectively delivers the process fluid into the processing space to maintain the processing space within a desired moisture range. When the moisture sensor measures a moisture content within the processing space to be below the desired moisture range, the controller activates the fluid delivery system to dispense the process fluid into the processing space.

According to another aspect, the process fluid is one of a fluid mist and steam.

According to another aspect, the particulate removal phase is initiated at the beginning of a laundry cycle and includes saturating articles using the fluid delivery system to achieve the desired moisture range of the articles.

According to another aspect, the moisture sensor is a conductivity sensor that is in communication with the processing space.

According to another aspect, the airflow path includes a particulate filter that has a particulate sensor. The particulate sensor of the particulate filter measures an amount of particulate that is captured within a mesh screen of the particulate filter.

According to another aspect, the particulate sensor is in communication with the controller.

According to another aspect, the particulate removal phase is conducted after a rinse phase of the laundry cycle.

According to another aspect, a moisture sensor, the particulate sensor, and the controller cooperate to determine whether to initiate one of a subsequent particulate removal phase and the conventional state of the laundry cycle.

According to another aspect, the particulate sensor is in communication with the blower and monitors a current drawn by the blower to determine an amount of particulate captured by the mesh screen of the particulate filter.

According to another aspect of the present disclosure, a laundry appliance includes a blower that delivers process air through an airflow path that includes a processing space. A heater is in thermal communication with the airflow path. The heater operates to deliver thermal energy to the process air. A fluid delivery system selectively directs a flow of process fluid into the processing space. A moisture sensor monitors a moisture content present within the processing space. A controller is in communication at least with the heater, the fluid delivery system and the moisture sensor, wherein during operation of a laundry cycle, the heater, the blower, and the fluid delivery system cooperatively operative a particulate removal phase that maintains articles in a damp state for a predetermined period of time. The damp state of the articles is monitored by the moisture sensor and prevents accumulation of an electrostatic charge within the processing space, and further allows the process air to separate particulate matter from the articles. Upon completion of the particulate removal phase, the heater operates at a conventional state that operates to dry the articles.

According to another aspect, the process fluid is one of a fluid mist and steam.

According to another aspect, the particulate removal phase is initiated by the beginning of a laundry cycle and includes saturating articles using the fluid delivery system to achieve the moisture content of the articles to be within a desired moisture range.

According to yet another aspect of the present disclosure, a method for separating particulate from articles includes the steps of saturating articles within a processing space with process fluid, activating a blower and a heater to deliver heated process air and unheated process air through the processing space, monitoring a moisture content within the processing space using a moisture sensor, maintaining the moisture content within the processing space to be within a desired moisture range to prevent accumulation of electrostatic charges between particulate matter and the articles within the processing space, separating the particulate matter from the articles using the heated process air and the unheated process air while the moisture content is within the desired moisture range, and activating a conventional drying operation to dry the articles.

According to another aspect, the step of maintaining the moisture content to be within the desired moisture content range includes activating a fluid delivery system that delivers process fluid into the processing space to further saturate the articles.

It will be understood by one having ordinary skill in the art that construction of the described disclosure and other components is not limited to any specific material. Other exemplary embodiments of the disclosure disclosed herein may be formed from a wide variety of materials, unless described otherwise herein.

For purposes of this disclosure, the term "coupled" (in all of its forms, couple, coupling, coupled, etc.) generally means the joining of two components (electrical or mechanical) directly or indirectly to one another. Such joining may be stationary in nature or movable in nature. Such joining may be achieved with the two components (electrical or mechanical) and any additional intermediate members being integrally formed as a single unitary body with one another or with the two components. Such joining may be permanent in nature or may be removable or releasable in nature unless otherwise stated.

It is also important to note that the construction and arrangement of the elements of the disclosure as shown in the exemplary embodiments is illustrative only. Although only a few embodiments of the present innovations have been described in detail in this disclosure, those skilled in the art who review this disclosure will readily appreciate that many modifications are possible (e.g., variations in sizes, dimensions, structures, shapes and proportions of the various elements, values of parameters, mounting arrangements, use of materials, colors, orientations, etc.) without materially departing from the novel teachings and advantages of the subject matter recited. For example, elements shown as integrally formed may be constructed of multiple parts or elements shown as multiple parts may be integrally formed, the operation of the interfaces may be reversed or otherwise varied, the length or width of the structures and/or members or connector or other elements of the system may be varied, the nature or number of adjustment positions provided between the elements may be varied. It should be noted that the elements and/or assemblies of the system may be constructed from any of a wide variety of materials that provide sufficient strength or durability, in any of a wide variety of colors, textures, and combinations. Accordingly, all such modifications are intended to be included within the scope of the present innovations. Other substitutions, modifications, changes, and omissions may be made in the design, operating conditions, and arrangement of the desired and other exemplary embodiments without departing from the spirit of the present innovations.

It will be understood that any described processes or steps within described processes may be combined with other disclosed processes or steps to form structures within the scope of the present disclosure. The exemplary structures and processes disclosed herein are for illustrative purposes and are not to be construed as limiting.

What is claimed is:

1. A laundry appliance comprising:

a drum that rotates about a rotational axis and defines a processing space for drying articles therein;

a blower that delivers process air through an airflow path that includes the processing space;

a heater in thermal communication with the airflow path, wherein the heater operates to deliver thermal energy to the process air;

a controller in communication with the drum, the blower, and the heater; and a moisture sensor, wherein the controller is in communication with the moisture sensor, wherein, during operation of a laundry cycle, the heater, the drum and the blower cooperatively operate a particulate removal phase that maintains the articles within the processing space in a damp state for a predetermined period of time, wherein the controller, in response to moisture measurements from the moisture sensor, operates the heater to maintain the articles in the processing space in the damp state during the particulate removal phase, and wherein the damp state of the articles prevents accumulation of an electrostatic charge within the articles and a surface of the drum, and further allows the process air to separate particulate matter from the articles in the processing space.

2. The laundry appliance of claim 1, wherein the particulate removal phase includes the heater operating at approximately 50% power.

3. The laundry appliance of claim 1, wherein the particulate removal phase includes the heater operating intermittently, wherein the blower cooperates with the heater to alternatively deliver heated process air and unheated process air to the processing space.

4. The laundry appliance of claim 1, wherein at a completion of the particulate removal phase, the controller prompts a user to initiate one of a subsequent particulate removal phase and a conventional state of the laundry cycle.

5. The laundry appliance of claim 1, further comprising a fluid delivery system that directs a flow of process fluid into the processing space, wherein the fluid delivery system is in communication with the controller and the moisture sensor.

6. The laundry appliance of claim 5, wherein the fluid delivery system selectively delivers the process fluid into the processing space to maintain the processing space within a desired moisture range, wherein when the moisture sensor measures a moisture content within the processing space to be below the desired moisture range, the controller activates the fluid delivery system to dispense the process fluid into the processing space.

7. The laundry appliance of claim 6, wherein the particulate removal phase is initiated at the beginning of the laundry cycle and includes saturating articles using the fluid delivery system to achieve the desired moisture range of the articles, and wherein after completion of the particulate removal phase, the heater operates at a conventional state that operates to dry the articles.

8. The laundry appliance of claim 5, wherein the process fluid is one of a fluid mist and steam.

9. The laundry appliance of claim 1, wherein the moisture sensor is a conductivity sensor that is in communication with the processing space.

10. The laundry appliance of claim 1, wherein the airflow path includes a particulate filter having a particulate sensor, wherein the particulate sensor of the particulate filter measures an amount of particulate that is captured within a mesh screen of the particulate filter.

11. The laundry appliance of claim 10, wherein the particulate sensor is in communication with the controller.

12. The laundry appliance of claim 11, wherein the moisture sensor, the particulate sensor and the controller cooperate to determine whether to initiate one of a subsequent particulate removal phase and a conventional state of the laundry cycle.

13. The laundry appliance of claim 12, wherein the particulate sensor is in communication with the blower and monitors a current drawn by the blower to determine an amount of particulate captured by the mesh screen of the particulate filter.

14. The laundry appliance of claim 1, wherein the particulate removal phase is conducted after a rinse phase of the laundry cycle.

15. A laundry appliance comprising:

a blower that delivers process air through an airflow path that includes a processing space defined within a rotating drum;

a heater in thermal communication with the airflow path, wherein the heater operates to deliver thermal energy to the process air;

a fluid delivery system that selectively directs a flow of process fluid into the processing space;

a moisture sensor that monitors a moisture content present within the processing space, wherein the fluid delivery system directs the flow of process fluid into the processing space when the moisture sensor measures a moisture content within the processing space that is below a desired moisture range indicative of a damp state for a particulate removal phase; and a controller in communication at least with the heater, the fluid delivery system and the moisture sensor, wherein during operation of a laundry cycle, the heater, the blower, the moisture sensor, and the fluid delivery system cooperatively operate the particulate removal phase that maintains articles within the processing space in the damp state for a predetermined period of time, wherein the damp state of the articles within the processing space is monitored by the moisture sensor and prevents accumulation of an electrostatic charge within the processing space, and further allows the process air to separate particulate matter from the articles within the processing space, and wherein upon completion of the particulate removal phase, the heater operates at a conventional state that operates to dry the articles.

16. The laundry appliance of claim 15, wherein the process fluid is one of a fluid mist and steam.

17. The laundry appliance of claim 15, wherein the particulate removal phase is initiated at the beginning of the laundry cycle and includes saturating articles using the fluid delivery system to achieve the moisture content of the articles to be within a desired moisture range.

18. The method of claim 17, wherein the particulate removal phase includes the heater operating at approximately 50% power to maintain the moisture content within the processing space to be within a desired moisture range.

19. A method for separating particulate from articles being dried, the method comprising the steps of:

saturating articles within a processing space of a rotating drum with process fluid to achieve a desired moisture range within the processing space;

activating at least one of a blower and a heater to deliver process air through the processing space to define a particulate removal phase;

monitoring a moisture content within the processing space using a moisture sensor;

maintaining the moisture content within the processing space to be within the desired moisture range to prevent accumulation of electrostatic charges between particulate matter and the articles within the processing space;

separating the particulate matter from the articles using the heated process air and the unheated process air while the moisture content is within the desired moisture range; and activating a conventional drying operation to dry the articles.

20. The method of claim 19, wherein the step of maintaining the moisture content to be within the desired moisture content range includes activating a fluid delivery system that delivers process fluid into the processing space to further saturate the articles.

* * * * *